US005231945A

United States Patent [19]

Ackerbloom

[11] Patent Number: 5,231,945

[45] Date of Patent: Aug. 3, 1993

[54] POWER BOAT HULL

[76] Inventor: T. Robert Ackerbloom, 4751 Rosewood Dr., Orlando, Fla. 32806

[21] Appl. No.: 765,168

[22] Filed: Sep. 25, 1991

[51] Int. Cl.[5] ..... B63B 1/04

[52] U.S. Cl. ..... 114/56; 114/290; 114/291

[58] Field of Search ..... 114/56, 57, 274, 291, 114/288, 289, 290

[56] References Cited

U.S. PATENT DOCUMENTS

| | | | |
|---|---|---|---|
| 1,559,660 | 11/1925 | Ward | 114/57 |
| 3,117,544 | 1/1964 | Schoell | 114/56 |
| 3,216,389 | 11/1965 | Thorsen | 114/56 |
| 3,515,087 | 6/1970 | Stuart | 114/57 |
| 4,233,920 | 11/1980 | Wood et al. | 114/56 |
| 4,465,009 | 8/1984 | Wood et al. | 114/56 |
| 4,584,959 | 4/1986 | Allison | 114/291 |
| 4,672,905 | 6/1987 | Pipkorn | 114/56 |
| 4,723,928 | 2/1988 | Riley | 114/56 |
| 4,813,365 | 3/1989 | Lindstrom et al. | 114/56 |

*Primary Examiner*—Jesus D. Sotelo
*Assistant Examiner*—Stephen P. Avila
*Attorney, Agent, or Firm*—Allen, Dyer, Doppelt, Franjola & Milbrath

[57] ABSTRACT

A power boat hull that has central running surface and na outer running surface that flanks the central running surface. The outer surface forms a channel with concave curvature which extends from the bow to the stern. The channel is shaped so that pressure builds in the channel during turning of the boat to lock the hull to water throughout the turn. A transom may be provided with a deflector plate having a curved surface that is lifted out of the water during high speed running of the boat and operatively deflects water downward to force the bow of the boat into the water during low speed running of the boat.

9 Claims, 2 Drawing Sheets

POWER BOAT HULL

BACKGROUND OF THE INVENTION

This invention relates to boat hulls used on power boats to lock the hull to the water during different maneuvers of the boat. More particularly, this invention relates to techniques for locking the boat to the water during turning or slow speed operations.

Deep vee hull is a commonly known boat construction technique. Examples of vee boat designs are disclosed in U.S. Pat. Nos. 4,233,920, 3117,544 and 4,465,009. Typical deep vee constructions include a center running surface flanked outward with a plurality of chines to form intermediate and outer running surfaces. A properly constructed vee bottom boat cuts through the water, displacing it on each side of the hull. Deep vee constructions are adequate for cutting through waves in water. However, due to the relatively large vee hull area, a great amount of drag is exerted at lower speeds. Further, vee hull constructed boats require that the center of gravity of the boat be well aft of amidships for high speed planing. Thus, the vee-hull has a tendency to operate with the bow up at low speeds.

At any speed when the Vee-hull boat is turned, the boat hull lays over to one side. As the boat lays over, it has a tendency to skip on the water creating an uncontrolled turn. The harder the boat is turned, the greater the uncontrollability of the turn.

Another drawback of Vee-bottom boats is that they develop spray when the boat hull displaces water. This spray often splashes up the side of boat onto the passengers.

One common Vee-hull design exhibits a deep sharp vee at the bow of the boat along with a variety of contours at the transom to provide stern lift at slow speeds. This hull design creates a large surface area that contacts the water when the boat is turned. An inherent problem with this large surface area is that the water surface on which the boat turns does not always remain constant. Consequently, when a boat with a lifting structure at its stern is turned in choppy water, the water may hook the bow resulting in a dip or a spin.

To assist in turning maneuvers, Vee-hull designs reduce the degree of vee at the transom. However, the reduced degree of vee at the transom increases water impact on rough water causing a harder, less comfortable ride.

SUMMARY OF THE INVENTION

A Vee-bottomed boat hull is provided with a central running surface and an outer running surface that forms a channel having in cross-section a concave curvature that extends from the bow of the hull to the extreme aft. This deep concave channel captures displaced water and directs it to the rear of the boat where the after portion of the channel turns down the water to lift the rear of the boat. This downturning occurs only during takeoff and at moderate boat running speeds. At high speeds, the channel is lifted out of the water so that water passes along the boat with no adverse affect on the softness of the ride.

However, at any speed when the boat is turned, the hull lays over on one side where the channel again becomes effective. The water trapped under the hull is channeled aftward. Preferably, the concave curvature is angled down at the rear of the hull and the depth of the concave curvature gradually decreases from amidship to the stern. The pressure created at the rear of the channel pushes the forward section of the channel down even harder thereby increasing the effectiveness of the channel. Thus, the harder the boat is turned, the harder the channel works to create a smooth, positive controlled turn.

The bow section of the hull flares inwardly and is concave, gradually running into mid and rear sections of the concave channel. By maintaining a substantial concave curvature under the bow of the boat, an added benefit is created of keeping spray under the bow and preventing passengers from getting wet. Also, by extending a concave curved channel to the extreme bow, the channel captures air under the hull when the boat runs at high speeds generating lift. This air trapped in the channel under the hull adds stability to the boat's ride when the boat runs through choppy water.

What makes the channel so effective is that as more pressure is created at one end of the channel, pressure is increased at the opposite end. Control is maintained due to the area of water being used for controlling the turning of the boat is reduced to a relatively small uniform common area under the boat.

Bow up during takeoff is prevented on the hull with a recessed transom that is located behind a central running surface. The transom has a deflector plate molded into its bottom. The deflector plate forms a step with a central running surface. The plate lifts above the water when the boat hull travels at high speed. The curvature of the deflector plate achieves its maximum depth at its midpoint and then decreases from mid-transom to the stern. Water is channeled directly against the angled deflector plate by the walls on each side of the recessed concave area. The water flowing into the concave must exit by passing under the angled plate, the increased pressure and the greater angle of attack of the plate create a much greater amount of lift at the transom than a flat transom extension running parallel to the bottom of the hull. This deflection angle helps force the bow of the boat into the water when the boat travels at low speeds.

DESCRIPTION OF THE PREFERRED EMBODIMENTS

Figure 1:
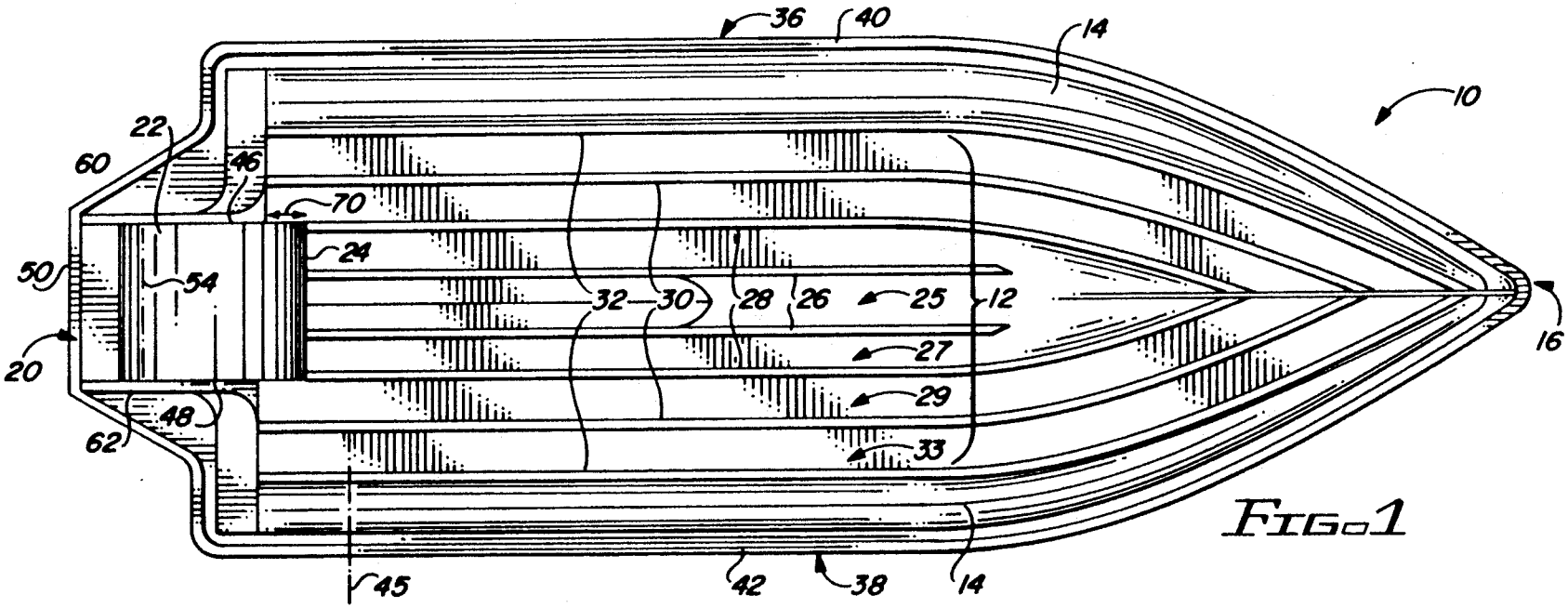
FIG. 1 is a bottom view of the boat hull.
Figure 2:
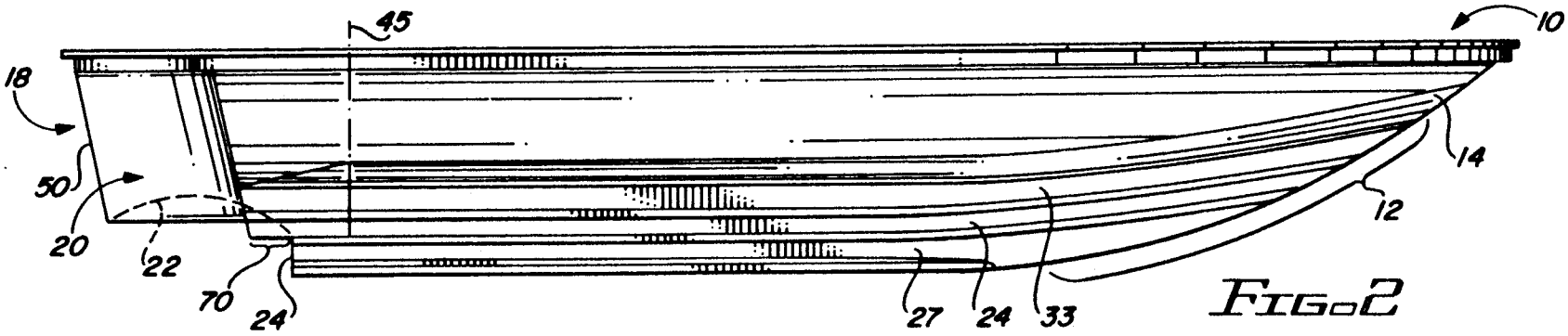
FIG. 2 is a right side view of the boat hull shown in FIG. 1.

Referring to FIGS. 1–4 there is shown a deep vee entry hull 10 for use on a power boat. The hull 10 has an inner running surface 12 extending from the bow of the boat to the stern 18, and an outer running surface 14 extending from the extremity of bow 16 of the hull 10 to the stern 18. Referring to FIGS. 1–2 and 4–6, disposed on the stern 18 of boat hull 10 is transom 20 having a deflector plate 22 with concave curvature. Plate 22 is recessed to form a step 24 with respect to inner running surface 12.

Referring to FIGS. 1–4, extending from fore to aft on hull 10 within inner running surface 12 are chine pairs 26, 28, 30 and 32. Chine pairs 26 extend from step 24 along transom 20 to a point fore of amidship. Chine pair 26 form a central running surface 25 there between. Chine pairs 26 and 28, 28 and 30, and 30 and 32, form a first intermediate running surface 27, a second intermediate running surface 29 and a third intermediate running surface 33, respectively. Disposed along the perimeter of starboard and port side of entry hull 10 are side walls 36 and 38 respectively, which extend downward to form lips 40 and 42 respectively, on the bottom of hull 10.

Inner running surface 12 extends fore and aft of the hull, the cross-section of which transitions from a pronounced vee to a substantially planar configuration after amidship. In addition, each of the intermediate running surfaces 27, 29 and 33 successively flank the central running surface 25 and extend fore and aft while transitioning from a pronounced vee to a substantially planar configuration. Flanking the third intermediate surface 33 is outer running surface 14. Outer running surface 14 forms a channel 44 having a cross-section of concave curvature (see FIG. 7) commencing at the extreme bow end of hull 10 and extending to the extreme aft end or stern 18 of hull 10.

Figure 7:
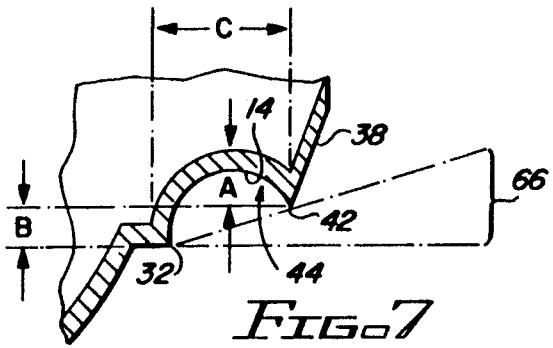
FIG. 7 is a section view of the outer channel of the boat hull along line 7—7 of FIG. 1.
Figure 3:
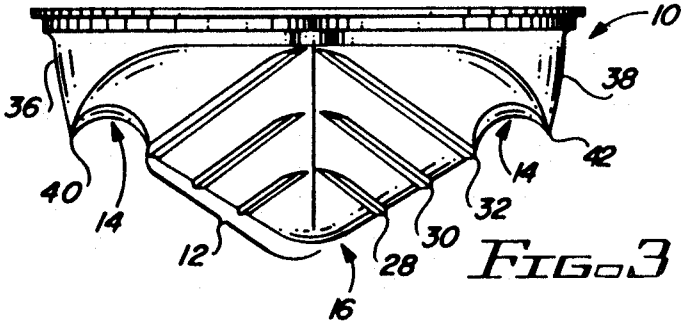
FIG. 3 is a front view of the boat hull shown in FIG. 1.

Referring to FIG. 7 there is shown channel 44 at an amidship point of hull 10. The following Table 1 discloses preferred dimensions for the arc curvature, depth and chine 32 height of this outer running surface 14 at different locations of outer running surface 14 with respect to bow 16. The dimensions for Table 1 are for a boat with overall dimensions of nineteen-feet, three-inches and width of seven feet.

TABLE 1

| | (in inches) | | |
|---|---|---|---|
| Distance From Bow | A | B | .C |
| 26 | 1.375 | 1.75 | 7.25 |
| 72 | 1.5 | 2.0 | 7.75 |
| 96 | 1.75 | 2.0 | 8.5 |
| 120 | 1.75 | 1.75 | 9.5 |
| At Stern | 1.875 | 0 | 7.25 |

Figure 6:
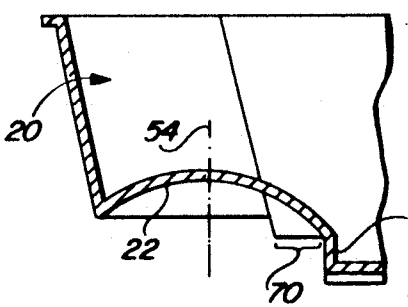
FIG. 6 is a side section view of the transom cut along line 6—6 of FIG. 1.

Referring to FIG. 6, it is preferable that the depth of concave curvature gradually decreases from location 45 to the stern at an angle of 6° designated by number 58. This angle 58 provides maximum lock down of the bow of the hull in the water during turning. Further, on a nineteen-foot three-inch boat hull, it is preferable that location 45 be positioned about twenty-six inches fore of the stern extremity of outer running surface 14. It is also preferable that the surface of lip 40, shown in FIG. 7, and designated by number 66, be 7° with respect to the horizon above the surface of chine 32 and the hull when the hull 10 is resting in a horizontal upright position.

Figure 4:
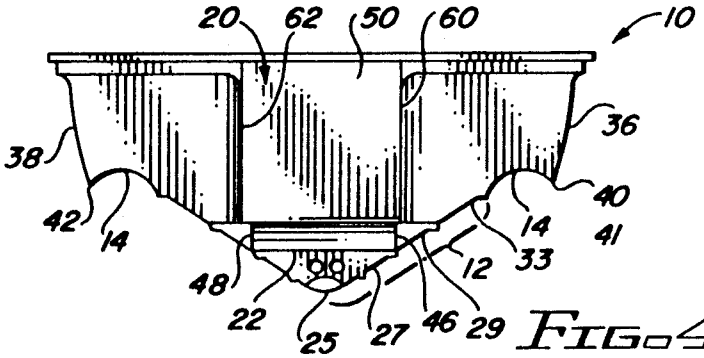
FIG. 4 is a rear view of the boat hull shown in FIG. 1.
Figure 5:
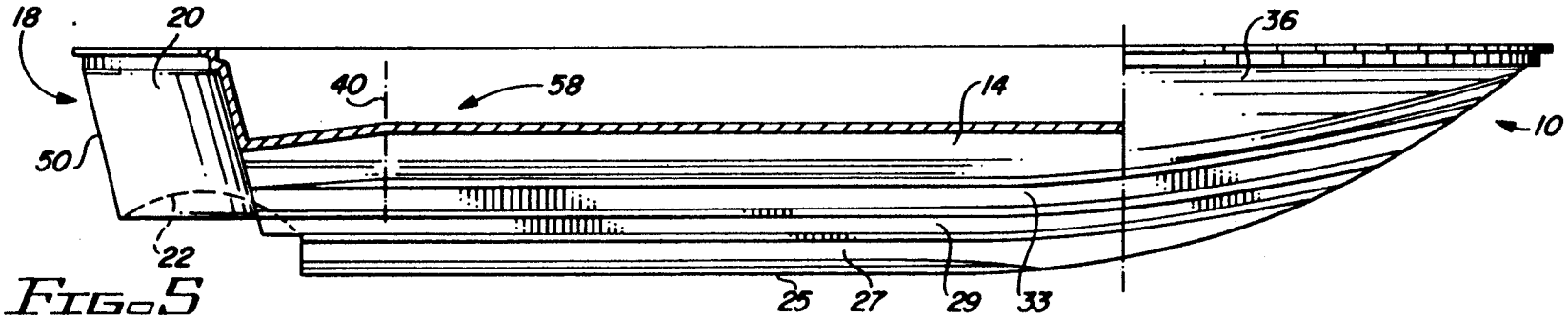
FIG. 5 is a side section view of the boat hull' outer channel sectioned along line 5—5 of FIG. 1.

Referring to FIGS. 1, 4 and 6, transom 20 includes deflector plate 22 bounded by transom step side walls 46 and 48. The transom has outside side walls 60 and 62. At this aft portion, deflector plate 22 is integrally formed with deflector stern wall 50. Deflector plate 22 is recessed with respect to central running surface 25 and first intermediate running surface 27. Referring to FIG. 6, step 24 is formed between transom 20 and central running and first intermediate running surfaces 25 and 27.

Deflector plate 22 extends from before the stern portion of hull 10 aftward away from hull 10. Deflector plate has concave curvature extending from step 24 to deflector stern wall 50. This deflector plate reaches its maximum depression point at mid-transom designated as number 54. The deflector plate then decreases its depth from mid-transom point 54 to deflector stern wall 50. When a boat hull travels at low speeds, water passes across the surface deflection plate 22. The plate on the aforementioned nineteen-feet, three-inch boat preferably has a maximum depth of 1.75 inches and a length of 17.75 inches. Plate 22 surface is preferably recessed into boat hull by 3.5 inches designated by number 70. The hydrodynamics of the curvature of plate 22 forces the bow of the boat downward at low speeds. The level of the surface of the deflector plate in cross-section from side wall 46 to side wall 48 remains horizontal and is not angled upwards or downwards. When the boat hull travels at high speeds, the plate rises above the level of the surface of the water so as not to create drag on the boat hull.

This concludes the description of the preferred embodiments. A reading by those skilled in the art will bring to mind various changes without departing from the spirit and scope of the invention. It is intended, however, that the invention only be limited by the following appended claims.

What is claimed is:

1. A vee-power boat hull having a bow and a stern, comprising:

an inner running surface extending fore and aft of the hull, the cross section of the inner running surface transitioning from a pronounced vee to a substantially planar configuration from fore to aft;

an outer running surface flanking said inner running surface in the aft portion of the hull and forming a channel having a cross-section of concave curvature commencing at the bow and extending to the stern; and wherein the channel is positioned between opposing inside and outside lifts and, in cross-section, is defined by a first vertical dimension between an apex of curvature to a first imaginary horizontal line passing through the inside lift, a second vertical dimension between the first horizontal line and a second horizontal line passing through the outside lift, and a third horizontal dimension between the inside and outside lifts, the second dimension being essentially zero at the stern and gradually increasing toward the bow.

2. The hull as recited in claim 1 wherein said inner running surface further comprises a central running surface and an intermediate running surface wherein said intermediate running surface flanks said central running surface in the aft portion of the hull, said intermediate running surface having, with said central running surface, a vee configuration in cross-section.

3. The hull as recited in claim 1 wherein the depth of the concave curvature gradually decreases from amidship to the stern to lock the fore of the channel into the water when the boat makes a turn.

4. The boat hull recited in claim 1 wherein the first dimension is greatest at the stern and gradually decreases toward the bow.

5. The boat hull recited in claim 1 wherein the third dimension is greatest forward of the stern but rearwardly of midships, the third dimension decreasing fore and aft of the point of greatest dimension.

6. The boat hull recited in claim 1 wherein the channel decreases in depth at a gradual angle from a point aft of midships toward the stern.

7. The boat hull recited in claim 6 wherein the gradual angle is on the order of 6°.

8. A hull of a planing power boat comprising:

an inner running surface extending fore and aft of the hull, said running surface transitioning into a substantially planar configuration from fore to aft;

a transom disposed behind said inner running surface and having a deflector plate with a surface of concave curvature, said pate being recessed in said hull to exhibit a step with a central running surface, said transom surface positioned to be removed from the water when the boat travels at high speeds, said depth of said curvature being maximum at mid-transom, and the depth of said curvature decreasing from mid-transom to the stern to deflect the bow of the boat into the water when the boat travels at low speeds; and wherein the boat is free of any propeller or shaft within the curvature of the deflector plate.

9. The power boat hull as recited in claim 8 wherein the surface of the deflector plate in cross-section remains horizontal from fore to aft.

* * * * *